United States Patent [19]

Fienhold

[11] 4,398,669

[45] Aug. 16, 1983

[54] FLUID-SPRAY DISCHARGE APPARATUS

[75] Inventor: Stephen C. Fienhold, Ft. Collins, Colo.

[73] Assignee: Teledyne Industries, Inc., Fort Collins, Colo.

[21] Appl. No.: 794,958

[22] Filed: May 9, 1977

[51] Int. Cl.[3] ..... B05B 1/08

[52] U.S. Cl. ..... 239/447; 239/449; 239/554; 239/562

[58] Field of Search ..... 239/443, 444, 446, 447, 239/448, 449, 101, 562, 381–383, 563, 554, 555, 102

[56] References Cited

U.S. PATENT DOCUMENTS

| | | | |
|---|---|---|---|
| 1,307,226 | 6/1919 | Westlin | 239/563 |
| 1,890,156 | 12/1932 | König | 239/554 |
| 2,369,216 | 2/1945 | Crisp | 239/554 |
| 2,493,719 | 1/1950 | Garabedian | 239/563 |
| 3,189,284 | 6/1965 | Downey | 239/554 |
| 3,713,587 | 1/1973 | Carson | 239/447 |
| 3,786,995 | 1/1974 | Manoogian et al. | 239/449 |
| 3,801,019 | 2/1974 | Trenary et al. | 239/444 |
| 3,940,069 | 2/1976 | Gunzel, Jr. et al. | 239/394 |
| 3,958,756 | 5/1976 | Trenary et al. | 239/444 |
| 3,967,783 | 7/1976 | Halsted et al. | 239/447 |
| 4,068,801 | 1/1978 | Leutheuser | 239/102 |
| 4,081,135 | 3/1978 | Tomaro | 239/449 |

FOREIGN PATENT DOCUMENTS

| | | | |
|---|---|---|---|
| 563459 | 5/1957 | Italy | 239/562 |

*Primary Examiner*—John J. Love
*Assistant Examiner*—Michael J. Forman
*Attorney, Agent, or Firm*—Hugh H. Drake

[57] ABSTRACT

A fluid-spray discharge apparatus has a housing associated with a fluid inlet. Also associated is a fluid outlet and an arrangement for effecting pulsation of fluid delivered from the inlet to the outlet. The outlet is composed of a series of spaced-apart fluid conveyances. Associated with the housing are means for enabling selection of the number of the series of conveyances operative in the flow of the fluid. Also included is an arrangement of fluid dischargers disposed outwardly of the conveyances and fluid emitters disposed inwardly of the same. Internal diverters and channels enable the provision of fluid delivery from any of the combinations of entirely from the emitters, entirely from the dischargers, in a mixture from the emitters and the dischargers, entirely from the conveyances and in a mixture from the dischargers and the conveyances.

2 Claims, 29 Drawing Figures

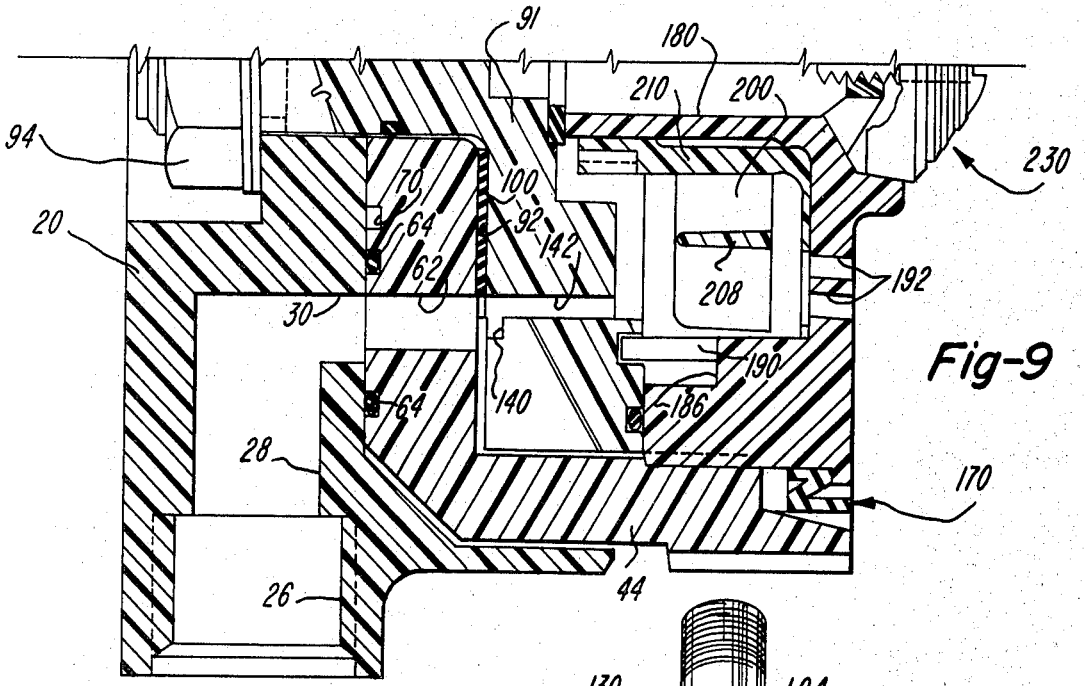
Fig-9
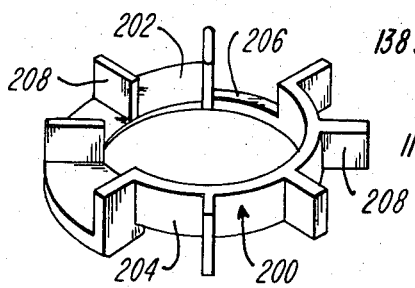
Fig-15
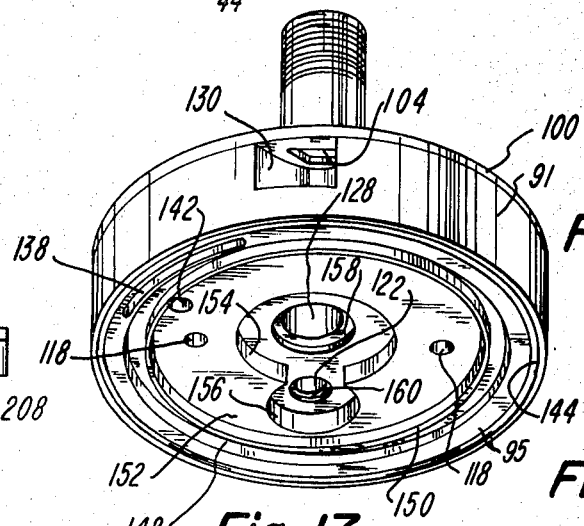
Fig-17
Fig-19
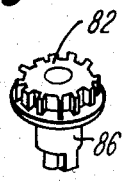
Fig-20
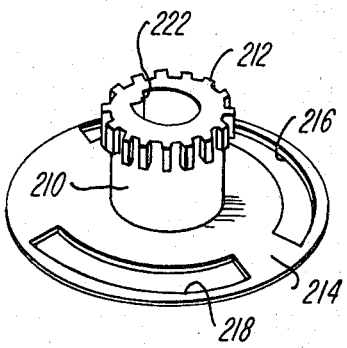
Fig-16
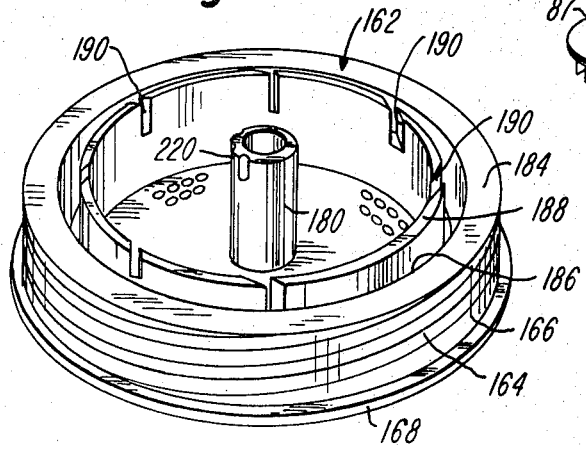
Fig-18
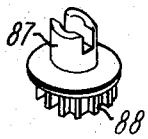

FLUID-SPRAY DISCHARGE APPARATUS

The present invention pertains to fluid-spray discharge apparatus. More particularly, it relates to such apparatus that has a variety of discharge characteristics.

Numerous mechanisms have been developed over the years for enabling the delivery of a pulsating stream of a fluid such as water. In recent times, comparatively great commercial attention has been directed upon devices of this general kind as particularly adapted to providing the delivery of a pulsating stream of water in a shower or the like utilized for bathing. The delivery of a pulsating stream enables a massage effect. At the same time, units in the marketplace have also provided for the selection of a more-or-less cone-spray of the kind delivered by a more conventional showerhead. Typical prior approaches are described in U.S. Pat. Nos. 3,762,648, 3,801,019, and 3,958,756. The disclosures of those patents feature the use of a rotating impeller so arranged as to chop the emitted stream of water into a series of pulsations. Other techniques for causing the emission of a pulsating stream include the use of fluidic oscillators. In any case, the aim has been to provide the user with the availability of a pulsating stream of water which creates a massage effect. Included in these approaches has been the feature of enabling the user to select to degree of variability as between the delivery of a pulsating effect and that of a continuous stream as in the more conventional showerhead. Of course, the simpler showerhead delivers only a cone-distribution of a plurality of jets of water.

For certain, showerheads of the foregoing character have enjoyed substantial commercial success in the marketplace. The existence of a pulsating effect and the combination therewith of different aspects of a continuous spray seem to have been accepted as desirable by the public. Nevertheless, all such prior approaches have been limited in their degree of flexibility of adjustment and usage.

It is, accordingly, a general object of the present invention to provide a new and improved fluid-spray discharge apparatus which enables an increased degree of performance over that hereinbefore produced.

Another object of the present invention is to provide a new and improved fluid-spray discharge apparatus that enables the user to have a significantly-higher degree of selection of effect.

A further object of the present invention is to provide such new and improved apparatus which is capable of being implemented in construction through the usage of readily-molded parts in connection with the formation of all of the essential particulars.

Still another object of the present invention is to provide a new and improved fluid-spray discharge apparatus that follows the general format of preceding commercially-successful apparatus of this sort and yet which provides the ultimate user with substantially enhanced flexibility and enjoyment of usage.

In accordance with one aspect of the invention, a fluid-spray discharge apparatus has a housing associated with a fluid inlet, a fluid outlet and means for effecting pulsation of fluid delivered from the inlet to the outlet. The outlet is defined as a plurality of spaced-apart fluid conveyances. Associated with the housing are means for enabling selection of the number of the plurality of conveyances operative in the conveyance of the fluid. Further features of the invention relate to arrangements of outer fluid dischargers and even the additional inclusion of inner fluid emitters, together with unique arrangements pertaining to selection as between the different ones thereof.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

FIG. 9 is again like FIG. 6 except that certain parts are in still another position and only the lower half of the cross-section is shown;

FIG. 15 is a perspective view of one component included in the apparatus of the preceding figures;

FIG. 16 is a perspective view of a component shown particularly in FIGS. 12–14;

FIG. 17 is a perspective view of another component included in the aforesaid apparatus;

FIG. 18 is a perspective view of a different component particularly shown in FIGS. 12–14;

FIGS. 19 and 20 are perspective views of respective parts included in the aforesaid apparatus;

Figure 1:
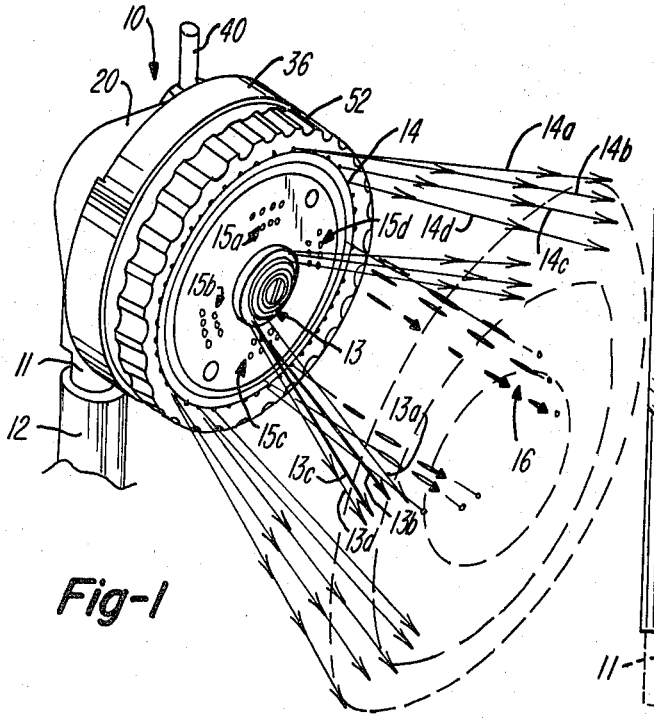
FIG. 1 is a fragmentary perspective view of one embodiment of a fluid-spray discharge apparatus coupled to a supply conduit.
Figure 2:
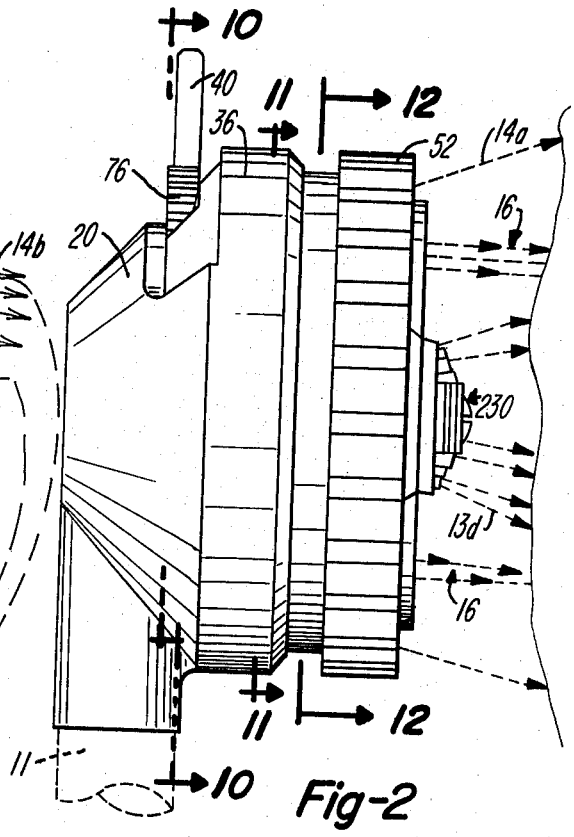
FIG. 2 is an enlarged side-elevational view of the apparatus of FIG. 1.
Figure 3:
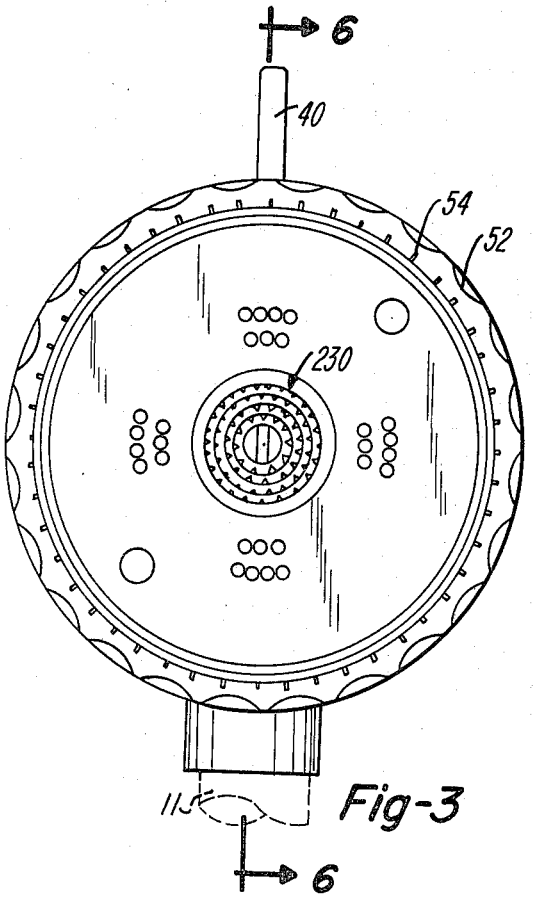
FIG. 3 is an enlarged front elevational view thereof.
Figure 4:
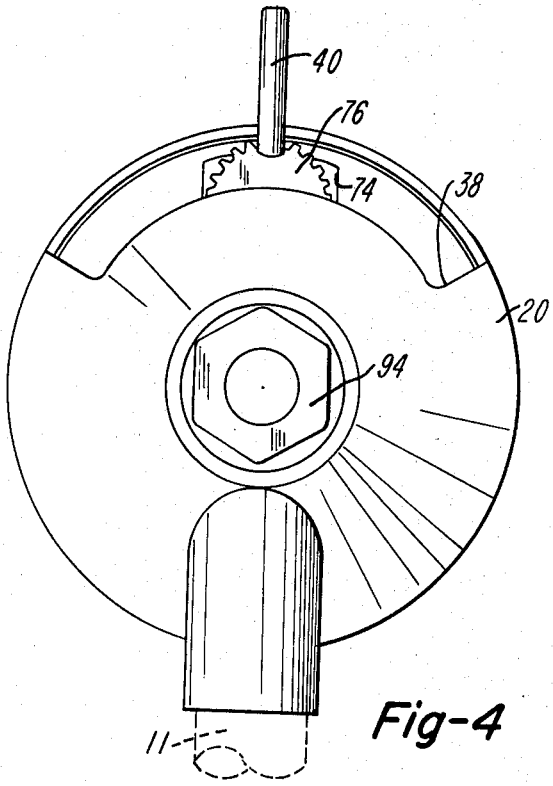
FIG. 4 is an enlarged rear elevational view thereof.

As shown in FIG. 1, a fluid-spray discharge apparatus 10 is connected by a coupling 11 to a water supply conduit 12 which may be either rigid or flexible. Under selective control to be explained in more detail, water may emerge from central emitters 13 as a series of continuous spray cones of successively greater divergence angle as represented by arrows 13*a*, 13*b*, 13*c* and 13*d*, from outer dischargers 14 in a series of paths 14*a*, 14*b*, 14*c* and 14*d* that together define a continuous spray cone or impulses from a variable number of groups 15*a*, 15*b*, 15*c* and 15*d* of conveyance orifices and along paths 16 generally inside the paths from the dischargers and encircling the paths from the emitters.

Figure 6:
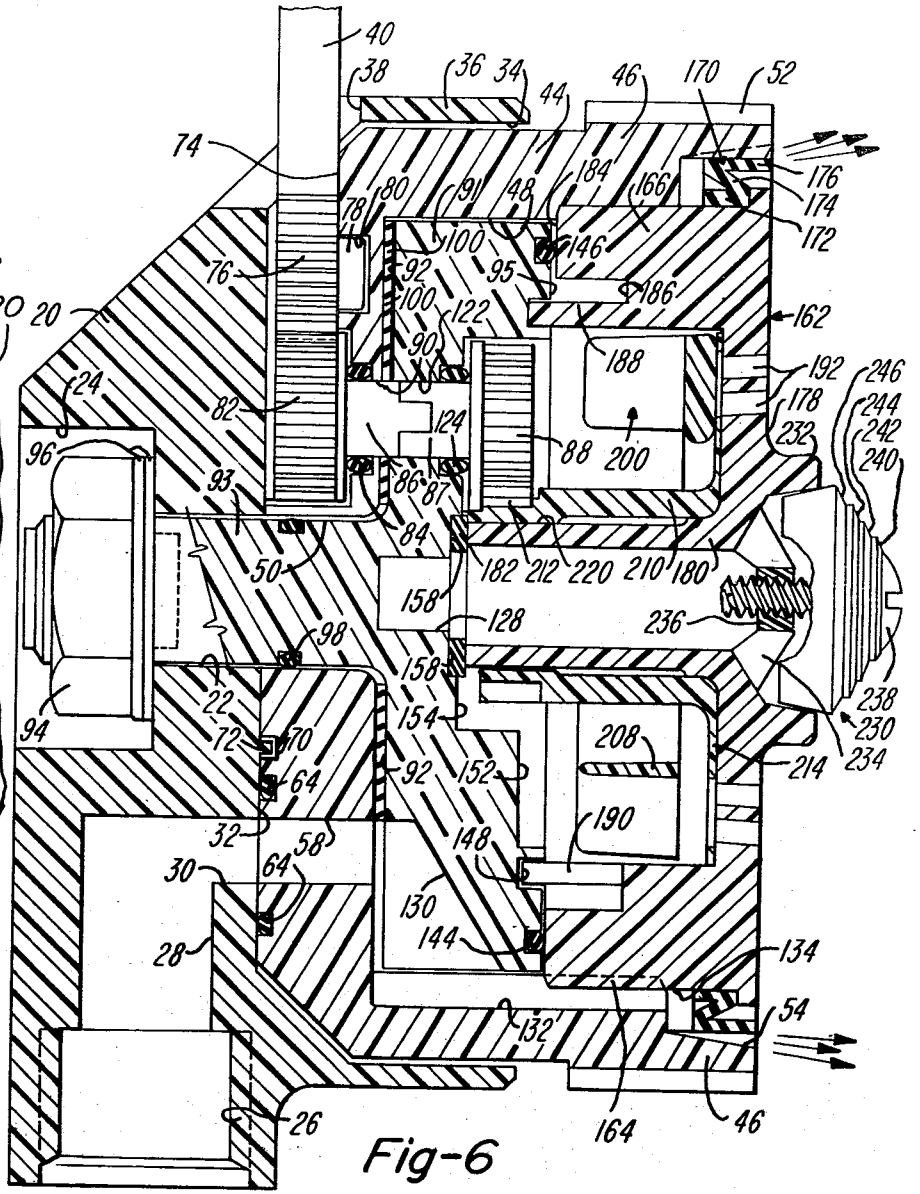
FIG. 6 is an enlarged cross-sectional view taken along the line 6—6 in FIG. 3.
Figure 5:
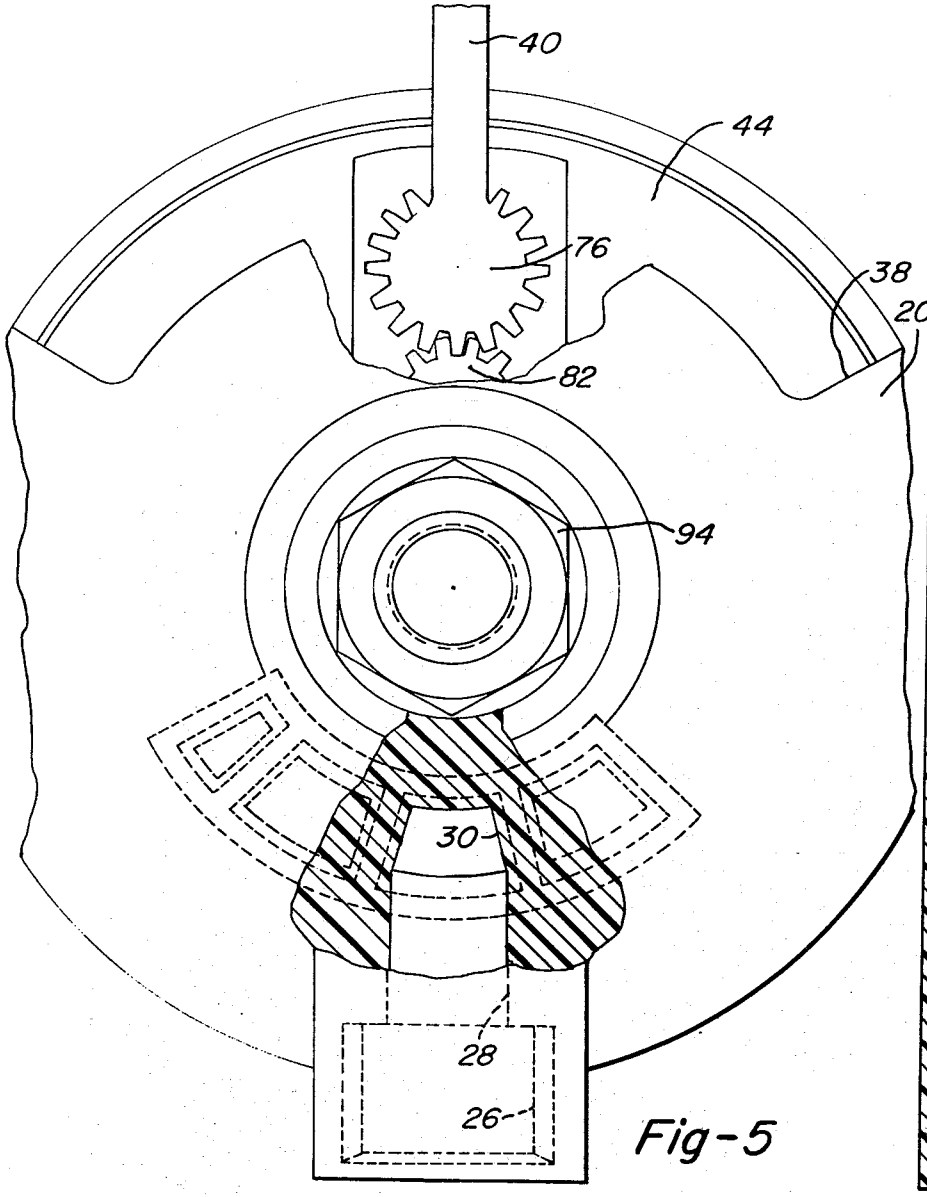
FIG. 5 is a further enlarged, fragmentary and partially broken away view taken from the same direction as in FIG. 4.
Figure 8:
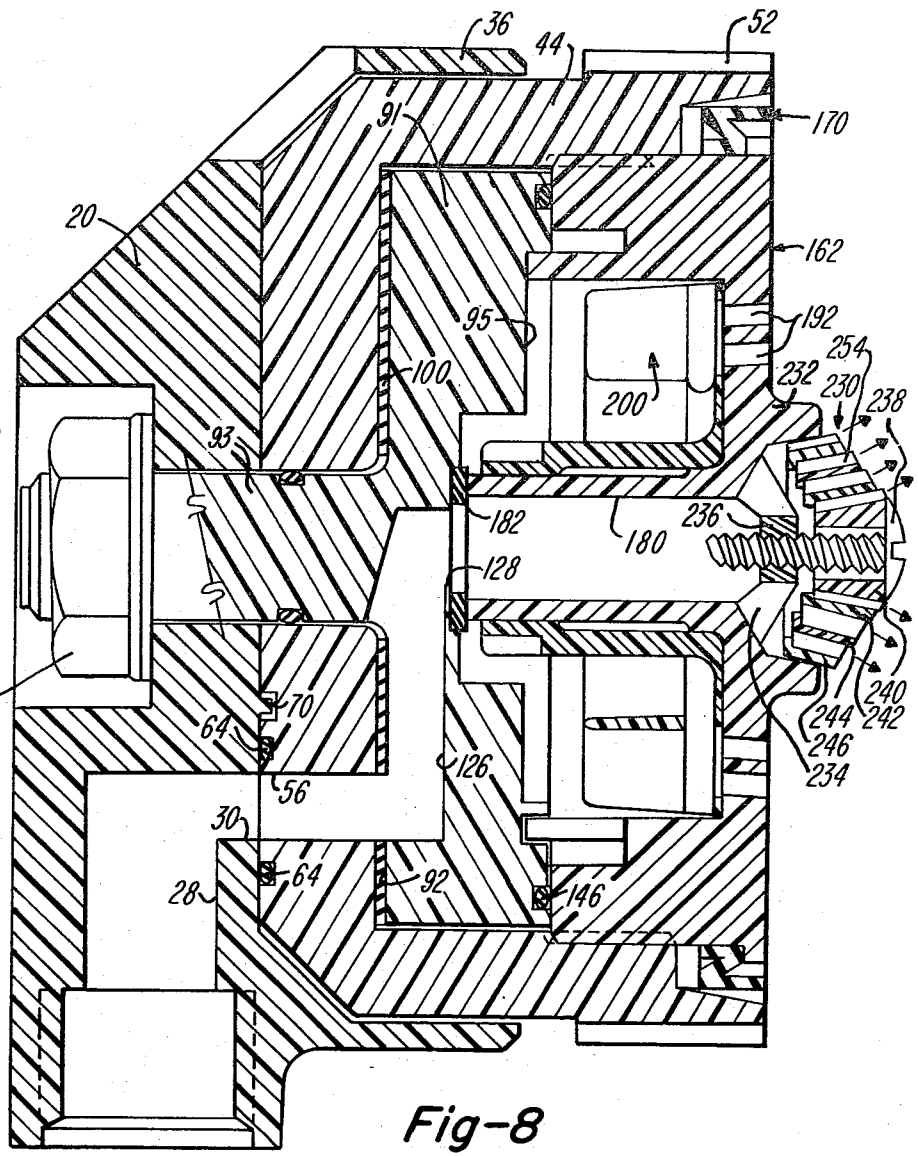
FIG. 8 is also like FIG. 6 except that certain parts are in a still different position and one sub-assembly is sectionalized.
Figure 27:
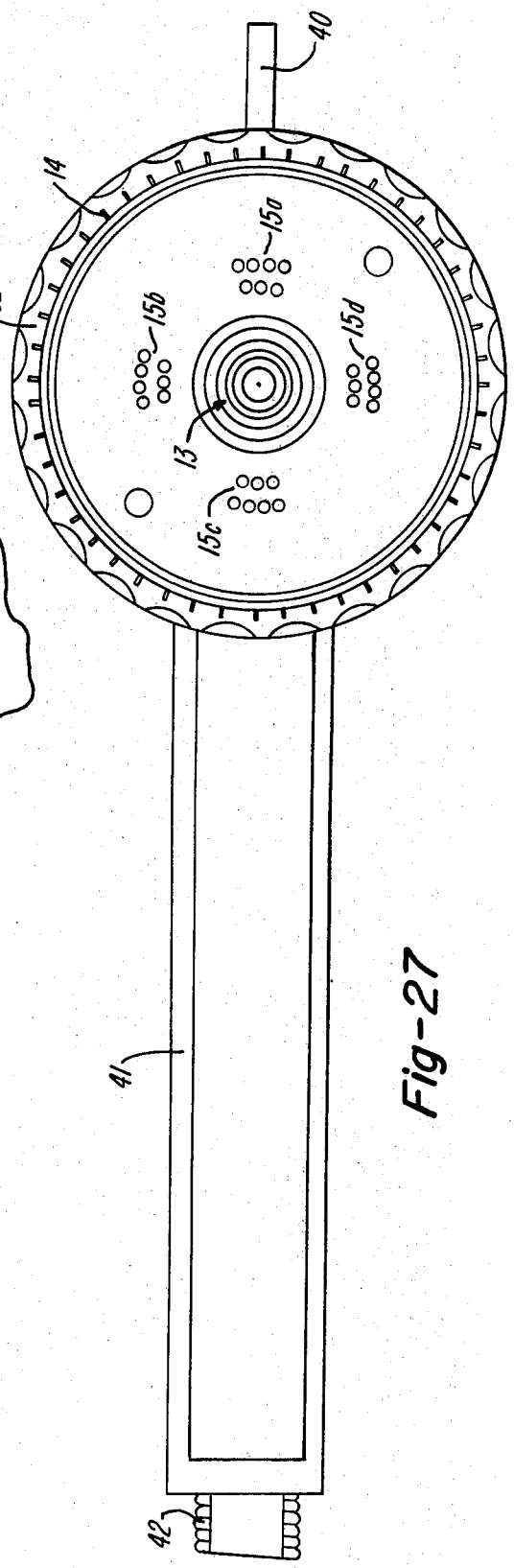
FIG. 27 is a plan view of another alternative embodiment.

In more detail, and with special reference to FIG. 6 for relative location of most of the parts, a shower spray in accordance with a first embodiment includes a base plate 20 that is formed to define a central mounting hole 22 defined in the bottom of a circular recess 24. Projecting into the bottom of base plate 20 is a fluid coupling 26 which communicates through a channel 28 to an aperture 30. Aperture 30 opens through the bottom wall 32 of a cup 34 formed by a circular flange 36 projecting laterally away from the central portion of base plate 20. A segment 38 in the intermediate portion of the wall which forms flange 36 is open to permit the protrusion therethrough of a lever 40. While inlet coupling 26 might be attached in a variety of ways to an external supply of water, the particular form of base plate 20 as shown in FIGS. 1-9 is contemplated for attachment to a flexible hose such as conduit 12 either directly or, preferably, by way of an integrally-coupled hollow handle 41 as shown in FIG. 27 and having a threaded nipple 42 at its remote end for connection to a flexible hose.

As best seen in FIG. 6, nested with cup 34 is a control housing 44 which has a circular flange or wall 46 so as to define another cup-shaped interior 48. In the bottom wall of housing 44 is a central opening 50 in alignment with hole 22. Disposed around the external forward periphery of flange 46 is a knurled ring 52 which enables movement of housing 44 circularly and relative to base plate 20. Distributed around the inner periphery of flange 46, opposite ring 52, are a succession of longitudinally-directed slots 54 that are part of dischargers 14 as shown in FIG. 1.

Figure 10:
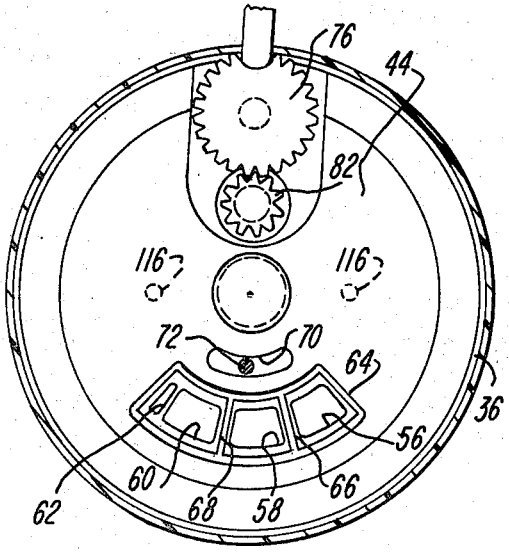
FIG. 10 is a cross-sectional view taken along the line 10—10 in FIG. 2.

Circularly distributed in a band through the bottom-wall of housing 44, and each alignable with aperture 30, are a series of openings 56, 58, 60 and 62 (see FIG. 10 and compare FIGS. 6, 7, 8 and 9). Each of these openings is in the shape of a segment of an annulus and is so located as to be alignable, in whole or in part, with aperture 30 which also is of such shape. Entirely circumventing openings 56, 58, 60 and 62 and seated in appropriate grooving in the bottom wall of housing 44 that faces wall 32, is a resilient seal 64. Cross ribs 66 and 68 of seal 64 respectively divide opening 56 from opening 58 and opening 58 from the combination of openings 60 and 62. Each of the openings 56, 58 and 60 is of approximately the same size as that of aperture 30. Thus, rotation of housing 44 relative to base plate 20 enables alignment as between aperture 30 and any one of those openings. In addition, a further degree of rotation allows a diversion of a portion of the inlet fluid flow from aperture 30 into smaller opening 62. Disposed radially inward of the openings is a segmental recess 70 into which is received a pin 72 which projects outwardly from wall 32 and serves to limit the degree of rotation of housing 44 relative to base plate 20.

As still best seen in FIG. 6, extending laterally inward into a portion of the bottom wall of housing 44 radially opposite openings 56, 58, 60 and 62 is a recess 74 which accommodates lever 40 and a spur gear 76 formed on the lower end of lever 40. Gear 76 includes an outwardly projecting shaft 78 which seats within a mating well 80 formed into the rear of the bottom wall of housing 44. An idler gear 82 is disposed within recess 74 and, extending through an O-ring 84, has a shaft 86 which is coupled to the corresponding shaft 87 of another idler gear 88. Shaft 86 extends through appropriate opening 90 formed in the bottom wall of housing 44 located centrally in the bottom of recess 74.

Figure 24:
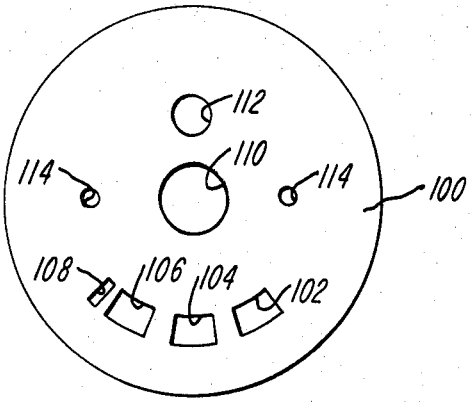
FIG. 24 is a plan view of another part included in said apparatus.
Figure 25:
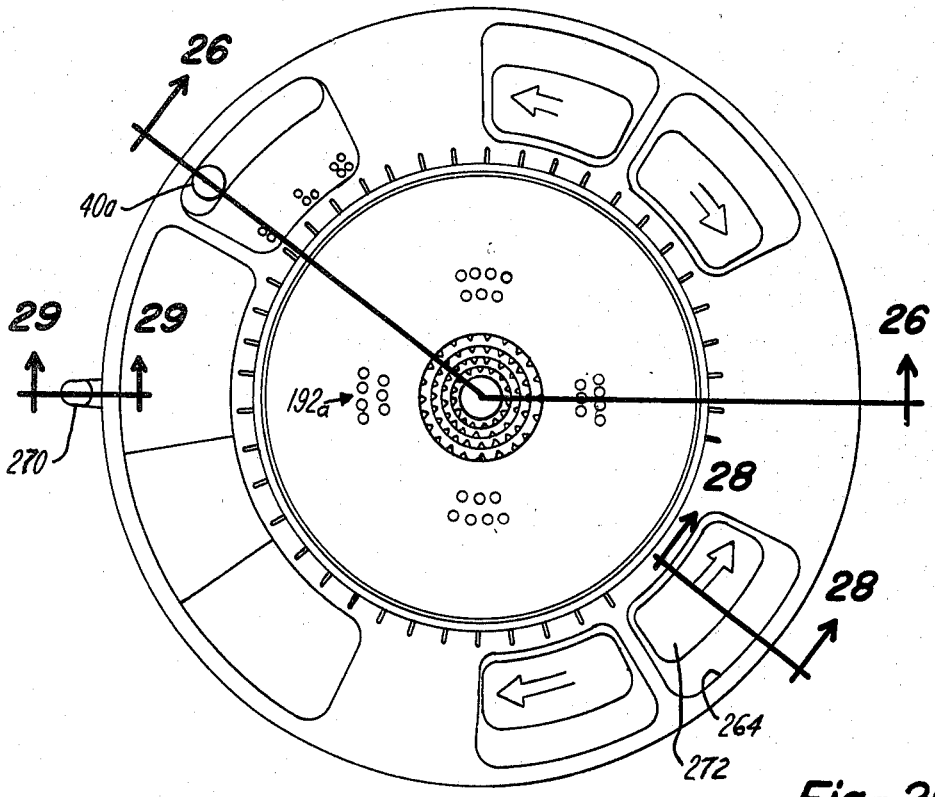
FIG. 25 is a front elevational view of an alternative embodiment.
Figure 26:
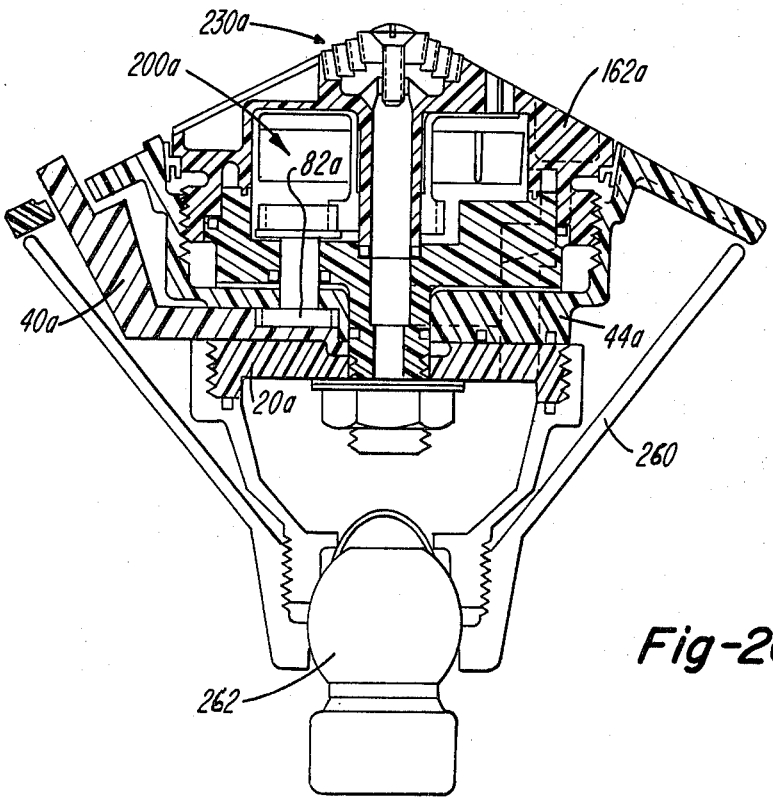
FIG. 26 is a cross-sectional view taken along the line 26—26 in FIG. 25.
Figure 28:
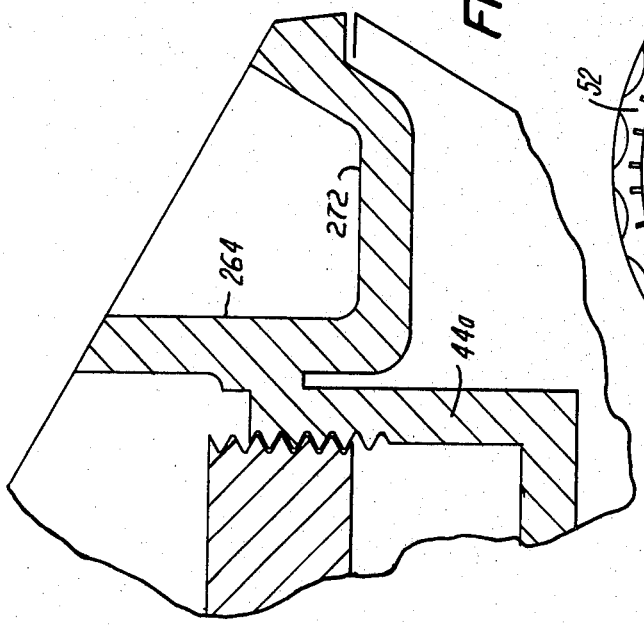
FIG. 28 is a fragmentary cross-sectional view taken along the line 28—28 in FIG. 25.
Figure 29:
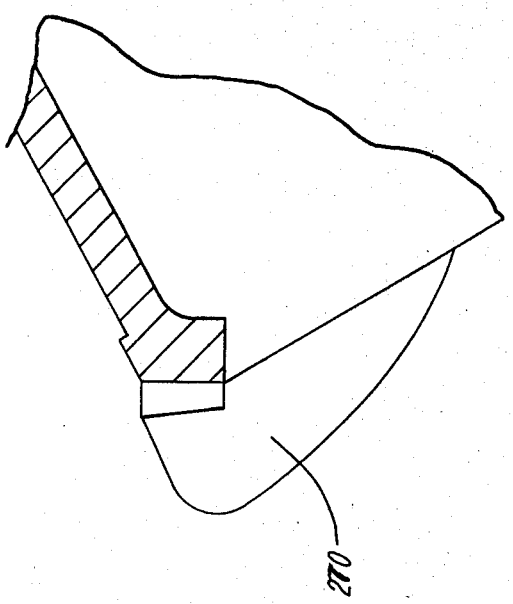
FIG. 29 is a fragmentary cross-sectional view taken along the line 29—29 in FIG. 25.

In turn nested within housing 44 is a flow director 91. Flow director 91 is generally in the shape of a disc that has a rear wall 92 and a front wall 94. Projecting rearwardly from the center of wall 92 is a shaft 93 which projects slidably through opening 50 and hole 22 into well 24. The outer end portion of shaft 93 is threaded to receive a nut 94 which is tightened against a pair of lock washers 96 in order to secure together in combinational relationship the parts thus far discussed while yet permitting housing 44 to be rotated about the central axis relative to base plate 20; depending upon degree of resiliency, only one washer 96 may be required. An O-ring 98 is seated within a corresponding groove in shaft 93 located within opening 50 when the parts are assembled. Sandwiched between rear wall 92 of director 91 and the facing portion of the bottom wall of housing 44 is a circular washer 100 of rubber or other resilient material (see FIG. 24). Washer 100 has a succession of openings 102, 104, 106 and 108 distributed in a band and individually in respective correspondence with openings 56, 58, 60 and 62 in housing 44. Also formed in washer 100 is a central opening 110 to accommodate shaft 92 and an opening 112 which accepts shaft 86 on idler gear 82. A pair of further openings 114 in washer 100 are aligned with a corresponding pair of wells 116 in housing 44 as well as with an also corresponding pair of openings 118 which extend through director 91. Upon assembly, a respective pair of pins 120 are cemented or otherwise staked in place so as to fix the rotative position of director 91 relative to housing 44. Another opening 122 extends through director 91 and is in alignment with opening 90 so as to receive shafts 86 and 87. Surrounding shaft 87 and seated within a corresponding counterbore within one end of opening 122 is a resilient O-ring 124.

Aligned with openings 56 and 102 is a channel 126 (FIGS. 8 and 11) recessed into wall 92 and leading to a central opening 128 formed in front wall 94 of director 91. Aligned with openings 58 and 104 is a passageway 130 (FIGS. 6 and 11) which tapers downwardly into wall 92 and outwardly through a segment of the periphery of director 91. Passageway 130 is aligned at its external end with a longitudinal channel 132 formed into the interior of flange 46 and leading to a manifold 34 which communicates with the inner end of each of slots 54.

Figure 7:
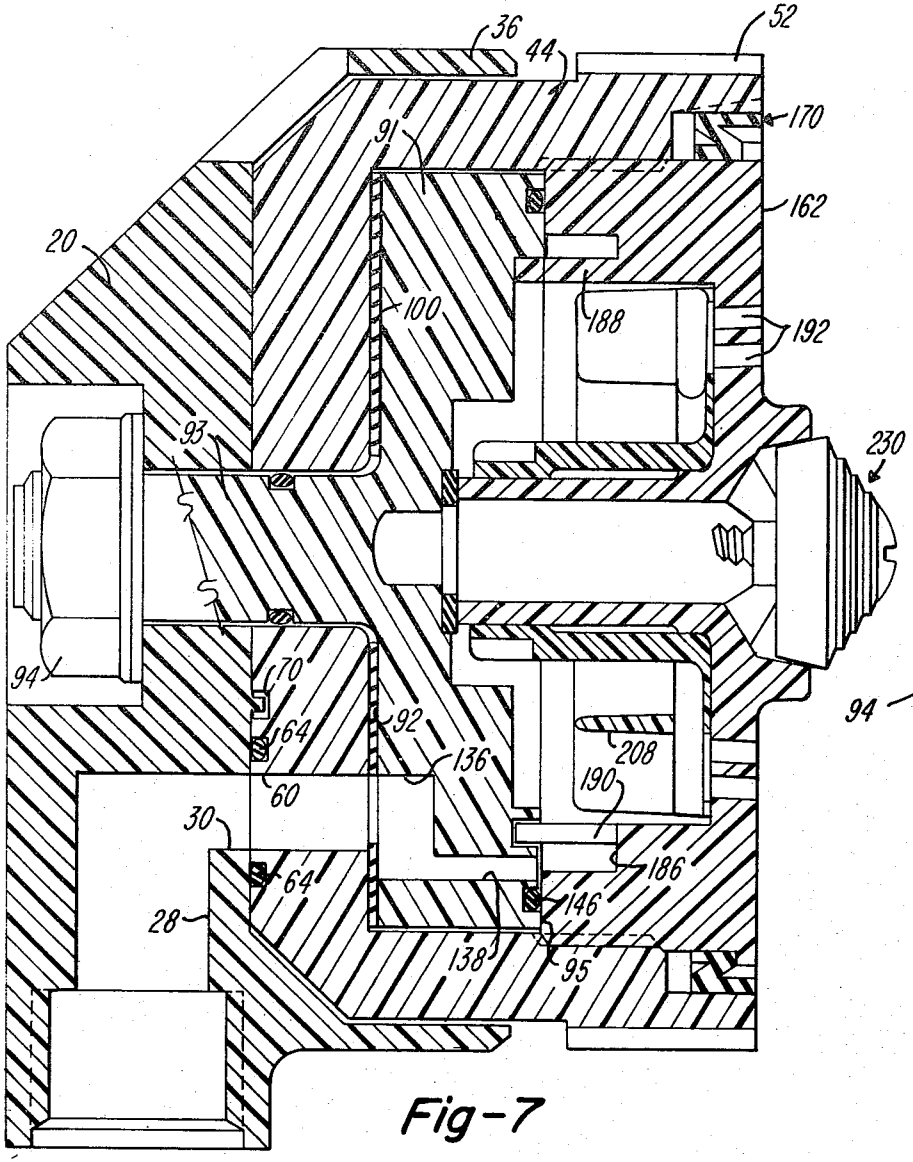
FIG. 7 is like FIG. 6 except that certain parts are in a different position.
Figure 11:
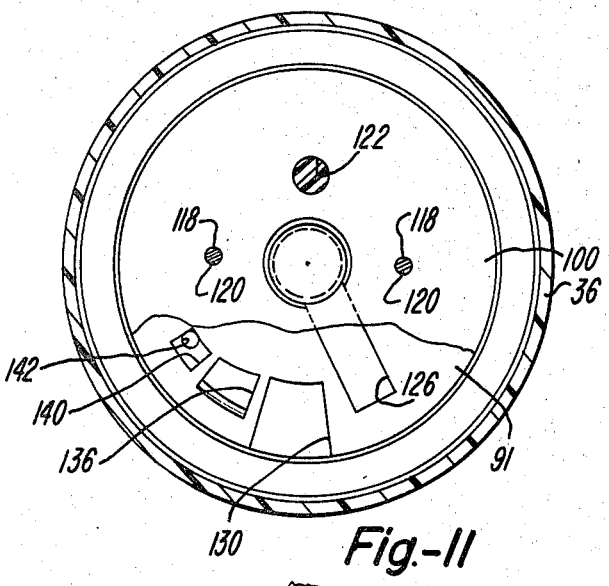
FIG. 11 is a cross-sectional view taken along the line 11—11 in FIG. 2.

A recess 136 formed into wall 92 is aligned with openings 60 and 106 (FIGS. 7 and 11). The bottom wall of recess 136 is formed through director 91 along its external periphery so as to communicate with a slot 138 formed as a narrow segmental band defined in wall 94 near its external periphery. Finally, a still further recess 140 is formed into wall 92 in alignment with openings 62 and 108 (FIGS. 9 and 11). Extending from the bottom wall of recess 140 directly on through the bottom wall of housing 44 is a small hole 142.

Inside the outer periphery of wall 94 (FIGS. 6 and 17), but running just outside of slot 138, is a circular groove 144 which seats a resilient O-ring 146. Disposed just inwardly of slot 138 in wall 94 is another circular groove 148. Beginning a short distance radially inward from groove 148, so as to leave a circular flange 150, the entire central portion of wall 94 is recessed inwardly as a first step to define a counterbore 152. Centrally in the bottom wall of counterbore 152 is a further generally-circular recess 154 overlapping with still another and somewhat smaller circular recess 156. Recess 154 is concentric with opening 128 and includes a further counterbore 158 around that opening. In the bottom wall of recess 156 is a counterbore 160 concentric with opening 122. The term "counterbore" is used herein merely to define shape; all of the different levels and surfaces preferably are formed as a part of a single molding operation.

Closing the forward end of housing 44 is an orifice cup 162. The interior end portion of the external wall of cup 162 is threaded as at 164 to mate with corresponding threads formed on a portion of the interior wall surface of flange 46. Outwardly beyond threads 164, the exterior lateral wall of cup 162 includes a smooth surface 166 which terminates in a flange 168 that projects radially outward. Encircling portion 166 is a generally Z-shaped seal 170 of a resilient material such as rubber. Seal 170 has a lower leg 172 bridged by a diagonal leg 174 to an upper leg 176. Lower leg 172 rides upon portion 166, while upper leg 176 spans the open side of all of slots 54 so as therewith to define a circular array of spray nozzles. In operation, water pressure in manifold 134 exerts force against the V-shaped wedge formed by legs 172 and 174 so as to secure sealing of seal 170 against flange 168 and to expand leg 176 tightly over slots 54.

Projecting rearwardly from a central opening through the radial wall 178 of cup 162 is a hollow tube 180 the innermost end of which is seated against a resilient washer 182 disposed in counterbore 158 on director 91. The inwardly facing surface 184 of the lateral wall of cup 162 is formed to define a circular groove 186 radially within which is a still-further-inwardly projecting flange 188. When all is assembled, the innermost end portion of flange 188 is received within groove 148 in director 91. Successively distributed around the circumference of flange 188 are a plurality of respective tangentially-oriented nozzles or slots 190 (see FIG. 18).

Formed through wall 178 of cup 162 are the plurality of different groups **15*a*–15*d* of outlet orifices 192. These groups are successively spaced symmetrically apart in a band that symmetrically encircles the location of tube 180 and yet is spaced radially inward from the location of slots 54. In comparing as between different ones of FIGS. 6–9, it should be noted that orifices 192 will not always be aligned to show in the illustrated cross-sectional planes. This is because rotation of housing 44 relative to base plate 20** will change their positions. Nevertheless, those orifices have been shown in all of these figures for functional clarity.

A rotary valve 200 faces toward the inner side of wall 178 and is retained in a free-floating manner by the interior surface of flange 188 for rotation about the central axis of the unit. As shown in FIG. 15, valve 200 is a one-piece molded element preferably formed from a glass-reinforced nylon material. It includes a flat, generally C-shaped plate 202 which lies in a radial general plane and, as shown, extends 135° about its central axis. Desirably, plate 202 has an extent of 180° as depicted in aforesaid U.S. Pat. No. 3,801,019. A semi-cylindrical wall 204 is integrally joined by a rib 206 to the opposite ends of plate 202 and extends angularly around 180° from one end of plate 202. Rib 206 completes the joinder at the other end of wall 204 to plate 202. The lower edge surface of wall 204 is coplanar with the top or upper flat surface of plate 202, so that the latter has its lower surface spaced downwardly from the lower edge of wall 204. A plurality of radially extending blades 208 integrally project from each of plate 202 and wall 204 in symmetrically-spaced relationship to the central axis of the unit.

Plate 202 is so located as to cover, at all times and rotative positions, at least a portion of the totality of orifices 192 in groups **15*a*–15*d*. The annular band within which those orifices lie corresponds in general to the annular path traversed by plate 202 upon rotation of valve 200. Blades 208 are so disposed as to be struck by water discharged through tangential passages 190, so that the valve is driven in rotation at a rate which varies with the rate of flow of water through those tangential passages. It will be observed that valve 200** includes the combination of a fluid-driven impeller and also functions as a fluid-flow chopper.

Figure 12:
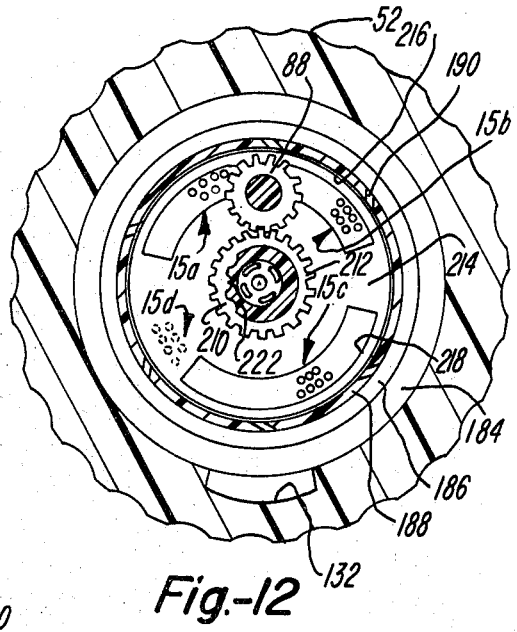
FIG. 12 is a cross-sectional view taken along the line 12—12 in FIG. 2, one part being omitted.

Rotatably received on tube 180 is a sleeve 210 which terminates at its innermost end in a spur gear 212 which mates with idler gear 88 so as to permit rotation of sleeve 210 about its central axis by movement of lever 40 (see FIG. 16). The other end of sleeve 210 terminates in a radially outward flange 214 disposed between valve 200 and the inner surface of wall 178. Formed through flange 214 are openings 216 and 218 each in a form of a circular band segment and so located as to be alignable with different ones of the orifices in groups **15*a–d*. For the case of such groups of orifices as illustrated, openings 216 and 218 preferably are separated by about 30° at one set of adjacent ends and by 60° at the other. Flange 214, with its band-shaped openings 216 and 218, thereby serves as a shutter. Through manipulation of lever 40, any combination of two, three or four of orifice or conveyance groups 15*a–d* may be uncovered for the outlet of water traveling through the cavity in which valve or impeller 200 is located. Those different relationships are illustrated respectively in FIGS. 12, 13, and 14. Openings 216 and 218 may be spanned by radial ribs so located circumferentially on flange 214** as to be clear of the orifices at each different selected position.

Figure 13:
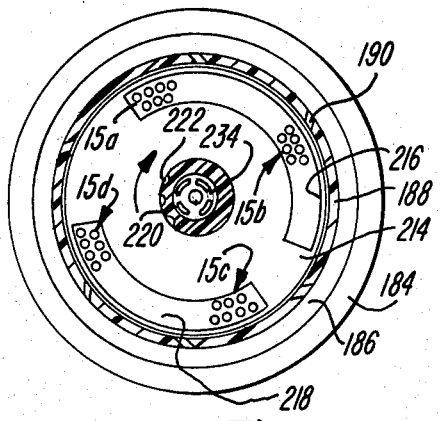
FIG. 13 is similar to FIG. 12 but has certain parts omitted and others in a different position.
Figure 14:
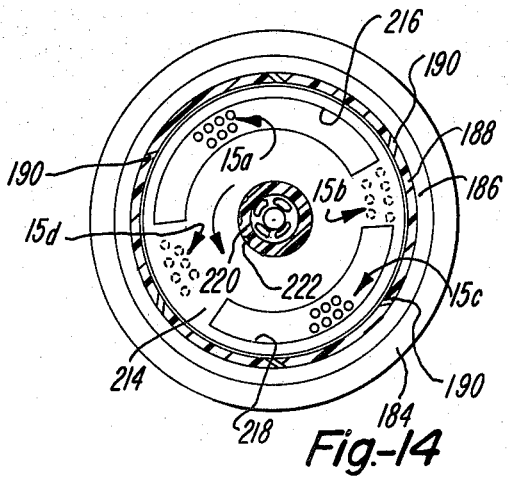
FIG. 14 is like FIG. 13 but with certain parts in another position.

Preferably included on the external surface of the inner end portion of hollow tube 180 are a circumferentially spaced series of longitudinally-oriented splines 220 (FIGS. 13 and 16). Projecting radially inward from the interior of sleeve 210, and in this case specifically in the direction opposite that of and beneath the teeth on gear 212, is a nub 222 seatable within any one of splines 220. Moreover, the material of which both tube 180 and sleeve 210 are formed, preferably a plastic, is sufficiently flexible to allow nub 222 to seat detentedly in any one of splines 220 as lever 40 is operated so as to rotate shutter 214 relative to the groups of orifices. To that end, splines 220 are spaced apart circumferentially so as to correspond to the exposure for outlet fluid flow respectively of two, three or four groups of the orifices in question. Alternatively, the detenting may otherwise be achieved as, for example, by forming a nub on the bottom surface of flange 214 and indentations in the inner surface of wall 178.

Figure 21:
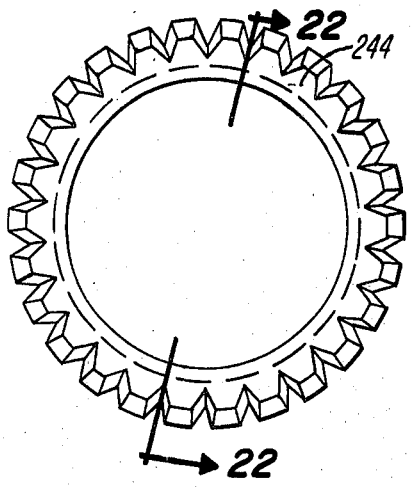
FIG. 21 is a plan view of a part included in said apparatus.
Figure 22:
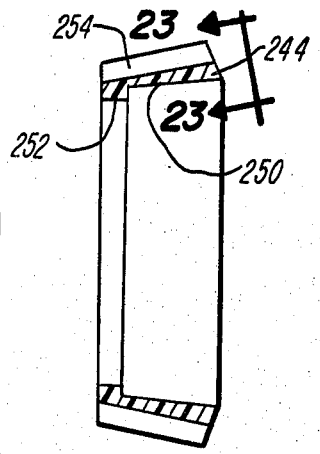
FIG. 22 is a cross-sectional view taken along the line 22—22 in FIG. 21.
Figure 23:
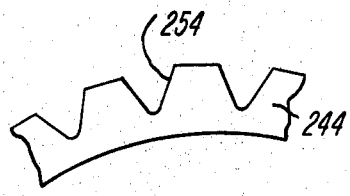
FIG. 23 is a fragmentary view taken along the line 23—23 in FIG. 22.

Completing the basic arrangement is a central spray or emitting assembly 230 that provides emitters 13. Assembly 230 is secured within an outwardly-projecting boss 232 integral with wall 178 and within the interior of which at the outlet end of sleeve 180 are a circumferentially-displaced succession of webs 234 which are joined at their innermost ends by a nut 236 which accepts a screw 238 that secures assembly 230 in place. Assembly 230 is in this case composed of a series of successively nested cone segments 240, 242, 244 and 246. Since each of the segments is essentially identical except for its divergence angle, only the structure of one need be described in detail. Accordingly, FIGS. 21–23 depict the structure of segment 244. It is in the general form of a ring having a tapered internal bore 250 terminating at its narrower radial dimension in an inwardly-turned lip 252. Around its outer lateral periphery are formed a series of slots 254. When the plurality of rings are all nested together, the inner surface 250 of each ring forms an outer wall outside of each of slots 254 so as to define therewith a spray nozzle. Of course, the inner wall of boss 232 cooperates with the outer ring 246 to complete such definition of the outer circumferentially-spaced series of orifices. In ring 240, inner surface 250 is parallel with the longitudinal axis, while the bottom of slot 254 tilts away from that axis by an angle of 8°. Also in ring 240, the central bore flares outwardly at an angle of 50° from the longitudinal axis so as to define a seat for the head of screw 238. Rings 242 has a five degree angle to the longitudinal axis for surface 250 and eight degrees for the bottom of slot 254. Preferably, ring 244 is formed so as to define the angle for surface 250 again at five degrees, while the bottoms of its slots 254 are angled at eleven degrees. Still further with regard to ring 246, corresponding surface 250 is angled with respect to the longitudinal at eight degrees, while the corresponding angle in the bottom of its slots 254 is defined at fourteen degrees. The end result is that water emerging through the interior of tube 180 is emitted through the various differently displaced arrays of circumferentially-spaced orifices in assembly 230 as a plurality of spray cones of successively greater divergence angle as viewed progressively away from the central axis of the unit. Each of lips 252 cooperates with the adjacent cone segment to define a restrictive orifice, causing a flow loss which results in a softer spray.

The user needs only to grasp knurled ring 52 so as to rotate housing 44 relative to base plate 20 and thus determine which of openings 56–62 is aligned wholely or partially in combination with opening 30 in base plate 20. When that adjustment results in full alignment of opening 58 with opening 30, all fluid flow is by way of passageway 130 and channel 132 to manifold 134 so as to result in what might be termed a normal diverging spray discharge from slots or dischargers 54. Upon adjustment of ring 52 so as to align slot 56 with aperture 30, inlet fluid flow is caused to course through channel 126, down the interior of tube 180 and proceed outwardly through all of the different apertures in the combination of cone assembly 230. This arrangement provides what might be termed a central spray as contrasted with the outermost spray of the preceding mode of adjustment. Turning ring 52 the other way so as to align aperture 30 with opening 60 results in the communication of the inletted fluid into slot 138 and therefrom through tangential passages 190 so as to impel blades 208 in a manner to cause rotation of valve 200. That impelling fluid is outletted through the exposed ones of orifice groups 15*a–d* in pulses in accordance with the ones of those groups exposed at any given time by the position of shutter 214. Further revolution of ring 52 results in the concurrent exposure of opening 62 to the inletted water so as to bypass a portion of the total fluid flow directly into the interior of cup 162 and not by way of tangential passages 190. This additional flow through opening 142 not only does not serve to drive the turbine part of valve 200 but actually serves to impede its revolution. The result is that valve 200 is slowed in rotation as ring 52 is adjusted so as to uncover opening 62 to the inletted water. In turn, this ends up in a reduction of the frequency of the pulses outletted through the exposed ones of orifice groups 15*a–d*. Of course, ring 52 may be adjusted so as to provide other than complete alignment between aperture 30 and the different ones of openings 56–62, so as to provide corresponding combinations of the different ones of the end results described.

Whenever ring 52 is so adjusted as to allow inletted water to enter into either of openings 60 or 62, valve 200 is caused to rotate so as to chop or pulsate the water emitted from orifice groups 15*a–d*. In this mode of operation, lever 40 may be actuated by the user so as to rotate shutter 214 and thereby determine whether a total of two, three or four of those groups is open for the transmission of that pulsated fluid flow; as a result, there is a change in velocity of the pulsed flow. When only two such groups are open to transmission, the pulsating action is most vigorous to the user. Manipulation on lever 40 to expose either three or four of such groups of orifices results in a progressively less-intense pulsating action. That is, the adjustment is one of variation between a gentle and a sharp pulstion effect.

FIGS. 1–24 depict one particular construction for achieving the present approach. It is to be noted, however, that a wide variety of rearrangement of specific shapes and conformations may be made in order to achieve different implementations of the overall specific concepts. The internal structure need not dictate the external shape or appearance. Thus, FIG. 27, already adverted to, depicts a hand-held version of such unit. In this version, handle 41 preferably is formed integrally with base plate 20.

Another version is shown in FIGS. 25, 26, 28 and 29. In this case, a wall-mounted version is shown. Thus, the rear portion of an external housing 260 is formed to accommodate the conventional swivel ball 262 affixed at the inlet of a shower spray in the typical installation. Internally, however, the various operating components function in the same manner. Thus, the principal parts have been designated by the same numbers as used hereinbefore but with the addition of the letter "a". Also, a lever 40*a* has been bent conveniently to the front or forward face of the unit. At the same time, fingerholes 264 in the main housing 44*a* enable control of the mode-selection process as between the different types of sprays or spray combinations. An indicator 270 informs the user as to mode selected. As indicated, various labeling areas, such as at 272, assist the user in the making of his choices.

Any of the versions specifically illustrated may be either of a wall-mounted or a hand-held type. Moreover, the various parts are capable of being formed in a wide variety of specific conformations as may be desired in order to achieve any particular overall appearance of the apparatus. Furthermore, all basic components may conveniently be molded of plastic.

All told, the embodiments described afford a great increase in versatility of usage. By enabling the selection of the number of conveyances operative in the delivery of pulsating fluid, the user may experience a variety of effects. In providing for fluid dischargers in addition to such conveyances, the variety of effect is still further enhanced. Going further, the provision of a still different emitting function enables an entirely different kind of spray. All this yields the possibility of satisfaction to the user with a more enhanced degree of variation. Yet, the structure needed involves a total assembly essentially no larger in size than that which is presently on the market but with the provision of many less total functions.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. In a fluid-spray discharge apparatus having a housing associated with a water inlet, a water outlet and means for effecting cyclic pulsation of water delivered from said inlet to said outlet, the improvement comprising:

means defining said outlet as a plurality of spaced apart water conveyances;

means associated with said housing for enabling selection of the number of said plurality of conveyances operative at any given time for the conveyance of the pulsating water;

an arrangement of water dischargers spaced from and in addition to said conveyances, and further means for selectively diverting water from said inlet as between said conveyances and said dischargers and in continuous flow to said dischargers;

a collection of water emitters spaced laterally from said conveyances in a direction opposite the spacing of said arrangement of dischargers, and further means for selectively channeling said water in continuous flow and as between said dischargers and said emitters;

said collection of emitters being disposed inside said conveyances and said arrangement of dischargers being disposed outside said conveyances;

said diverting means and channeling means together enabling the provision of water delivery from any of the combinations of entirely from said emitters, entirely from said dischargers, in a mixture from said emitters and said dischargers, entirely from said conveyances and in a mixture from said dischargers and said conveyances;

and a unitary member mounted within said housing and in which are defined a plurality of individual passageways respectively defining corresponding water communication for all different ones of said combinations upon rotational movement of respective portions of said housing.

2. In a fluid-spray discharge apparatus having a housing associated with a water inlet and a water outlet composed of water emitters, the improvement comprising:

said outlet including a nested stationary plurality of successively concentric rings, each ring including a circumferentially-spaced peripheral succession of forwardly-directed grooves each of which cooperates with a wall of a next-adjacent ring to define one of said emitters, and the respective grooves in different ones of said rings being at correspondingly-different angles so as, in the overall, to define a spray pattern characterised by a plurality of concentric but progressively more-diverging cones;

and different ones of said rings each having an upstream lip projecting laterally toward the adjacent ring a distance to define a flow-loss orifice that results in a softening of the emitted spray.

* * * * *